US010344951B2

(12) United States Patent
Aoki et al.

(10) Patent No.: US 10,344,951 B2
(45) Date of Patent: Jul. 9, 2019

(54) ILLUMINATING DEVICE

(71) Applicant: HITACHI KOKI CO., LTD., Tokyo (JP)

(72) Inventors: Yoshiki Aoki, Hitachinaka (JP); Shinichi Kakefuda, Hitachinaka (JP); Masanori Okada, Hitachinaka (JP)

(73) Assignee: Koki Holdings Co., Ltd., Tokyo (JP)

( * ) Notice: Subject to any disclaimer, the term of this patent is extended or adjusted under 35 U.S.C. 154(b) by 34 days.

(21) Appl. No.: 14/610,871

(22) Filed: Jan. 30, 2015

(65) Prior Publication Data

US 2015/0276182 A1 Oct. 1, 2015

(30) Foreign Application Priority Data

Mar. 25, 2014 (JP) ..... 2014-062329

(51) Int. Cl.
*F21L 4/02* (2006.01)
*F21V 14/02* (2006.01)
(Continued)

(52) U.S. Cl.
CPC ..... *F21V 14/025* (2013.01); *F21L 4/02* (2013.01); *F21L 4/027* (2013.01); *F21L 4/04* (2013.01);
(Continued)

(58) Field of Classification Search
CPC ..... F21V 14/025; F21L 14/02; F21L 14/027; F21L 14/04; F21L 14/022; F21L 14/025;
(Continued)

(56) References Cited

U.S. PATENT DOCUMENTS 3,030,497 A * 4/1962 Cheng ..... F21L 2/00 340/321
3,053,978 A * 9/1962 Rhoades ..... F21L 4/00 362/184
(Continued)

FOREIGN PATENT DOCUMENTS

CN 202972582 U 6/2013
CN 104647314 A 5/2015
(Continued)

OTHER PUBLICATIONS

Extended European Search Report EP Application No. 15153541.6 dated Sep. 24, 2015.
(Continued)

*Primary Examiner* — Matthew J. Peerce
(74) *Attorney, Agent, or Firm* — McDermott Will & Emery LLP

(57) ABSTRACT

In order to obtain an illuminating device that can carry out optimum illumination corresponding to various usage modes, the illuminating device includes a grip held by an operator and extending in a vertical direction; a battery connected to a lower end of the grip; and an irradiation part connected to an upper end of the grip, and the irradiation part is connected to the grip so that the irradiation part can be turned between a first position extending from the upper end of the grip to an upper side and a second position extending from the upper end of the grip to a lower side, a first lamp is provided on a grip-side end part of the irradiation part, and a second lamp is provided on a side surface of the irradiation part.

7 Claims, 7 Drawing Sheets

(51) Int. Cl.

| | |
|---|---|
| ***F21V 21/40*** | (2006.01) |
| ***F21V 23/04*** | (2006.01) |
| ***F21L 4/04*** | (2006.01) |
| ***F21V 1/00*** | (2006.01) |

(52) U.S. Cl.
CPC ..... *F21L 15/00* (2013.01); *F21V 21/406* (2013.01); *F21V 23/0414* (2013.01)

(58) Field of Classification Search
CPC ... F21L 4/02; F21L 4/022; F21L 4/025; F21L 4/027; F21L 4/04; B26B 11/008
USPC ..... 362/184
See application file for complete search history.

(56) References Cited

U.S. PATENT DOCUMENTS

| | | | | |
|---|---|---|---|---|
| 5,971,562 | A * | 10/1999 | Yang | F21L 4/045 362/184 |
| 5,988,828 | A * | 11/1999 | Prince | F21L 4/04 362/191 |
| 7,591,572 | B1 * | 9/2009 | Levine | A47F 11/10 362/191 |
| 7,731,385 | B2 * | 6/2010 | Spartano | H05B 35/00 362/184 |
| 2007/0014103 | A1 * | 1/2007 | Teng | F21L 4/027 362/157 |
| 2008/0304254 | A1 | 12/2008 | Canino et al. | |
| 2013/0335996 | A1 | 12/2013 | Yao et al. | |
| 2014/0268775 | A1 * | 9/2014 | Kennemer | F21L 14/00 362/249.03 |
| 2015/0136434 | A1 | 5/2015 | Aoki et al. | |

FOREIGN PATENT DOCUMENTS

| | | | |
|---|---|---|---|
| GB | 2324854 | A | 11/1998 |
| JP | 3084563 | U | 3/2002 |
| TW | M304621 | U | 1/2007 |
| WO | 2006/052910 | A2 | 5/2006 |

OTHER PUBLICATIONS

Office Action issued in corresponding Japanese Patent Application No. 2014-062329, dated Jun. 1, 2017, with English language translation.

First Office Action issued in Chinese Patent Application No. 2015100513596, dated Sep. 10, 2018 (English translation).

* cited by examiner

ILLUMINATING DEVICE

CROSS-REFERENCE TO RELATED APPLICATION

The present application claims priority from Japanese Patent Application No. 2014-062329 filed on Mar. 25, 2014, the content of which is hereby incorporated by reference into this application.

TECHNICAL FIELD OF THE INVENTION

The present invention relates to an illuminating device that radiates light.

BACKGROUND OF THE INVENTION

Examples of an illuminating device that is carried by an operator and can illuminate a desired location include torch lights. Torch lights are used for assisting operations in various operation environments. As the torch lights, those in various forms are known. For example, US Patent Application Publication No. US 2008/0304254 A1 (Patent Document 1) describes a torch light provided with a lamp, which irradiates a wide range, and a lamp, which particularly brightly irradiates a narrow range. The torch light of Patent Document 1 has a housing, which is provided with the two lamps, and a grip, which is held by an operator. In the torch light of Patent Document 1, the housing and the grip are turnably coupled. In the torch light having such a structure, a set angle of the housing is adjusted by the operator, and the lamps of two types are used depending on the use. Therefore, the torch light can be used in an optimum form in an operation.

For example, in a case in which a torch light is used at an outdoor workplace, the places illuminated by the torch light are various. Therefore, torch lights are installed at various places in various forms. For example, there are cases in which torch lights are placed on a floor, a desk, etc. and used thereon. On the other hand, torch lights are carried and used by operators in some cases. In this manner, illuminating devices such as torch lights have been required to appropriately illuminate desired ranges depending on various situations.

Further, even when a torchlight is carried and used, the usage mode thereof is various. For example, there is a case in which an apparatus is operated while an operator sees an instruction manual in a situation in which there is no illuminating device except for the torch light. In such a case, it is required to appropriately illuminate a plurality of locations at the same time.

As a power source of a torch light, a dry battery or the like can be used. However, for example in a case in which it is used in an outdoor operation, in order to improve convenience, it is preferred to use a high-capacity battery shared by other electric operation equipment (cordless driver, etc.) as the power source of the torch light. In the case in which the high-capacity battery is used, compared with the case in which a dry battery or the like is used as the power source, continuously-usable time of the torch light can be extended. However, since such a battery is large and heavy compared with the dry battery or the like, it is difficult to employ a long and thin form which can be easily handled as described in Patent Document 1. Therefore, using an illuminating device such as a torch light to which a battery is attached in the above-described various modes has made it difficult to handle the illuminating device for the operator.

In this manner, it has been difficult to obtain an illuminating device that can support various usage modes and carry out optimum illumination.

SUMMARY OF THE INVENTION

The present invention has been accomplished in view of such problems, and it is an object to provide the invention that solves the above-described problems.

In order to solve the above problem, the present invention provides configurations described below.

According to an embodiment of the present invention, an illuminating device includes: a grip held by an operator and extending in a vertical direction; a battery connected to a lower end of the grip; and an irradiation part connected to an upper end of the grip. The irradiation part is connected to the grip so that the irradiation part can be turned between a first position extending from the upper end of the grip to an upper side and a second position extending from the upper end of the grip to a lower side, a first lamp is provided on a grip-side end part of the irradiation part, and a second lamp is provided on a side surface of the irradiation part.

According to another embodiment of the present invention, an illuminating device includes: a grip held by an operator and extending in a vertical direction; a battery connected to a lower end of the grip; and an irradiation part connected to an upper end of the grip. The irradiation part is connected to the grip so that the irradiation part can be turned between a first position extending from the upper end of the grip to an upper side, a second position extending from the upper end of the grip to a lower side, and a third position extending from the upper end of the grip to a rear side, and the battery is disposed to be shifted to a front side with respect to the grip.

According to another embodiment of the present invention, an illuminating device includes: a grip held by an operator and extending in a vertical direction; a battery connected to a lower end of the grip; and an irradiation part connected to an upper end of the grip. The irradiation part is provided with a second lamp that irradiates a rear side of the grip, and the battery is disposed to be shifted to a front side with respect to the grip.

According to another embodiment of the present invention, an illuminating device includes: a grip held by an operator and extending in a vertical direction; a battery connected to a lower end of the grip; and an irradiation part connected to an upper end of the grip. The irradiation part is connected to the grip so that the irradiation part can be turned between a first position extending from the upper end of the grip to an upper side and a second position extending from the upper end of the grip to a lower side, the irradiation part is provided with a first lamp and a second lamp that irradiates a direction intersecting with a direction irradiated by the first lamp, and a switch capable of switching whether the first lamp is to carry out irradiation or the second lamp is to carry out irradiation is provided at a position at which the switch can be operated from outside even in a state that the irradiation part is at the second position.

According to another embodiment of the present invention, an illuminating device that has a battery retaining part retaining a battery provided at one, end side of a grip held by an operator and radiates light by a lamp that can change an irradiation direction of the light with respect to the grip, and the illuminating device includes a first lamp and a second lamp as the lamp, the first lamp is provided on an irradiation-part base part that is provided at the other end side of the grip via a first turning shaft and that can be turned about the first turning shaft, and the second lamp is provided at an irradiation-part distal end part that is provided on the irradiation-part base part via a second turning shaft and that can be turned about the second turning shaft.

According to another embodiment of the present invention, an illuminating device has a battery retaining part retaining a battery provided at one end side of a grip held by an operator and radiates light by a lamp that can change an irradiation direction of the light with respect to the grip. The lamp is provided on an irradiation part that is provided at the other end side of the grip via a first turning shaft and that can be turned about the first turning shaft, when the irradiation part is turned about the first turning shaft, the irradiation part is brought close to one side of the grip in a longitudinal direction of the grip, and a distance between the grip and a portion of the battery or of the battery retaining part that is the farthest from the grip in one side of the grip is shorter than a distance between the grip and a portion of the battery or of the battery retaining part that is the farthest from the grip in the other side of the grip.

Since the present invention is configured in the above-described manner, an illuminating device that can carry out optimum illumination corresponding to various usage modes can be obtained.

BRIEF DESCRIPTIONS OF THE DRAWINGS

DESCRIPTIONS OF THE PREFERRED EMBODIMENTS

A torch light (illuminating device), which is an embodiment of the present invention, will be explained. The torch light uses an attachable/detachable high-capacity battery as a power source. The torch light is provided with, as lamps which radiate light, a first lamp that has a wide irradiation angle and a second lamp that particularly brightly irradiates a range narrower than such an irradiation angle. The set angles (irradiation directions) of the first lamp and the second lamp are appropriately set depending on the usage mode of an operator. It is also possible to simultaneously adjust the first lamp and the second lamp to optimum set angles and simultaneously use the first lamp and the second lamp.

Figure 1A:
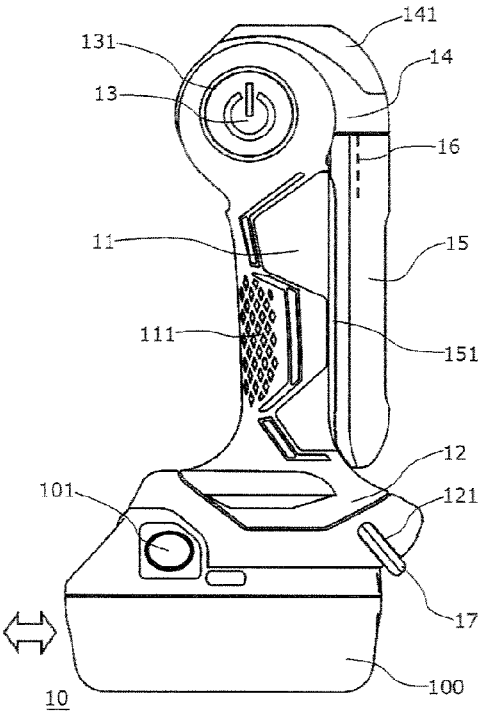
FIG. 1A is a side view of a torch light according to an embodiment of the present invention.
Figure 1B:
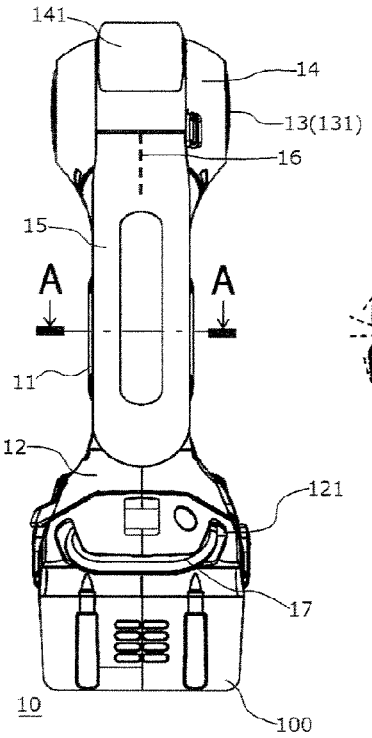
FIG. 1B is a front view thereof.
Figure 1C:
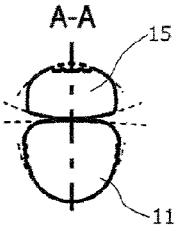
FIG. 1C is a cross-sectional view thereof.

FIG. 1A is a side view showing a torch light 10, and FIG. 1B is a front view showing the torch light 10. FIG. 1C is a cross-sectional view taken along a line A-A of FIG. 1B. Herein, FIG. 1A and FIG. 1B show a form of a case in which the torch light 10 is placed on a work table, a floor, or the like. FIG. 1B is a drawing showing the torch light 10 from the right side of FIG. 1A.

As shown in FIG. 1A and FIG. 1B, the torch light 10 has a grip 11 extending in a vertical direction. At one end (lower end in FIG. 1A and FIG. 1B) of the grip 11, a battery retaining part 12, which is thicker than the grip 11, is provided. In other words, as shown in FIG. 1A and FIG. 1B, the battery retaining part 12 is provided at the lower end of the grip 11. A battery 100, which is a power source, is attached to the battery retaining part 12. As shown in the drawing, the width of the battery 100 is formed to be wider and heavier than the grip 11. Therefore, in a state in which the battery 100 is attached to the battery retaining part 12, the battery 100 can function as a base, and the torch light 10 can be placed on a working table or the like. As shown in FIG. 1A, the grip 11 is not positioned at a center part of the battery 100, but is positioned to be deviated to the right side with respect to the battery 100.

In the present specification, the lower end (one end) of the grip 11 means a lower-side end part of the grip 11 shown in FIG. 1A. The upper end (the other end) of the grip 11 means an upper-side end part of the grip 11 shown in FIG. 1A. The rear side (one side) of the grip 11 means the right side of the grip 11 shown in FIG. 1A. The front side (the other side) of the grip 11 means the left side of the grip 11 shown in FIG. 1A. In other words, the rear side of the grip 11 means the side which contacts the palm of the operator when the operator holds the grip 11. The front side of the grip 11 means the side which contacts the fingers of the operator when the operator holds the grip 11.

The torch light 10 has an irradiation-part base part 14, which is attached to the other end (upper end in FIG. 1A and FIG. 1B) of the grip 11. In other words, as shown in FIG. 1A and FIG. 1B, the irradiation-part base part 14 is provided at the upper end of the grip 11. The irradiation-part base part 14 is provided at the other end of the grip 11 via a first turning shaft 13 and can be turned centering around the first turning shaft 13, in other words, can be turned about the first turning shaft 13. A long and thin irradiation-part distal end part 15 is attached to the irradiation-part base part 14. In this torch light 10, the irradiation-part base part 14 and she irradiation-part distal end part 15 constitute an irradiation part. The irradiation-part base part 14 is provided with a first lamp 141, and the irradiation-part distal end part 15 is provided with a second lamp 151. In other words, the irradiation part provided with the irradiation-part base part 14 and the irradiation-part distal end part 15 is connected to the upper end of the grip 11. Moreover, in the irradiation part, the first lamp 141 and the second lamp 151 are provided as lamps, which radiate light. The irradiation directions of the light radiated from the irradiation part can be changed with respect to the grip 11 by turning the irradiation part centering around the first turning shaft 13. In other words, the first lamp 141 is provided at the grip 11-side end part of the irradiation part, and the second lamp 151 is provided on a side surface of the irradiation part.

As shown in FIG. 1A, the irradiation-part distal end part 15 is formed to be long and thin along the grip 11. Therefore, the second lamp 151 is also formed to be long and thin along the grip 11. As the second lamp 151, for example, a plurality of LEDs are arranged to be long and thin, and a lamp having a configuration in which these LEDs are covered with a long and thin lens can be used. By virtue of such a configuration, the irradiation range (light projection range) of the second lamp 151 can be expanded. The second lamp 151 is suitable for irradiating a wide range, particularly.

On the other hand, as shown in FIG. 1A, the irradiation-part base part 14 is formed so as to cover an upper end part of the grip 11. Therefore, it is difficult to form the first lamp 141 to be long and thin like the second lamp 151. Therefore, the first lamp 141 can use a light source of high luminance. However, the first lamp 141 uses a lens which is smaller than that of the second lamp 151. The first lamp 141 is suitable for particularly brightly irradiating a particular location.

The first turning shaft 13 is fixed to the grip 11. The first turning shaft 13 is disposed in the direction perpendicular to the plane of the paper in the case shown in FIG. 1A and is disposed in a left-right direction in the case shown in FIG. 1B. The state shown in FIG. 1A is a state in which the irradiation-part base part 14 is turned about the first turning shaft 13 and the irradiation-part distal end part 15 is brought close to one side of the grip 11 along the longitudinal direction of the grip 11. In other words, FIG. 1A shows a state in which the irradiation-part base part 14 is turned about the first turning shaft 13 such that, in one side (right side in FIG. 1A) of the grip 11, the irradiation-part distal end part 15 abuts the grip 11 in the longitudinal direction thereof or the irradiation-part distal end part 15 is the closest to the grip 11 along the longitudinal direction thereof. FIG. 1A also shows a state in which the irradiation parts 13 and 15 are turned to a second position at which they are extending from the upper end of the grip 11 toward the lower side. In the state shown in FIG. 1A, both of the longitudinal direction of the irradiation-part distal end part 15 and the longitudinal direction (axial direction of the grip 11) of the grip 11 are the vertical direction in the drawing.

A switch 131, which switches the actuation state of the first lamp 141 and the second lamp 151, is provided at an end part of the first turning shaft 13. The switch 131 is operated when it is pushed in the axial direction of the first turning shaft 13. In other words, the switch 131 is a switch, which can switch whether the first lamp 141 is to carry out irradiation or the second lamp 151 is to carry out irradiation, and is provided at a position so that the switch can be operated from outside. When the switch 131 is operated, the actuation state of the first lamp 141 and the second lamp 151 is cyclically changed. For example, as the actuation state, (1) a state in which both of the first lamp 141 and the second lamp 151 do not light (are unlit), (2) a state in which only the first lamp 141 lights, (3) a state in which only the second lamp 151 lights, (4) a state in which both of the first lamp 141 and the second lamp 151 light, (5) a state in which only the first lamp 141 flashes, (6) a state in which only the second lamp 151 flashes, or (7) a state in which both of the first lamp 141 and the second lamp 151 flash can be set. Other than these, it may be set so that the illuminance of the first lamp 141 and the second lamp 151 is adjusted by operating the switch 131.

As shown by broken lines in FIG. 1A and FIG. 1B, the irradiation-part distal end part 15 is provided on the irradiation-part base part 14 via a second turning shaft 16. Thus, the irradiation-part distal end part 15 can be turned about the second turning shaft 16 with respect to the irradiation-part base part 14. The second turning shaft 16 is fixed to the irradiation-part base part 14, and, in the form of FIG. 1A and FIG. 1B, the second turning shaft 16 is disposed along the vertical direction. In this manner, the first turning shaft 13 and the second turning shaft 16 are orthogonal to each other like a multilevel crossing. The changes in the form of the torch light 10 in the case in which the irradiation-part base part 14 is turned about the first turning shaft 13 or in the case in which the irradiation-part distal end part 15 is turned about the second turning shaft 16 will be described later. In the form of FIG. 1A, since the second lamp 151 abuts the grip 11, illumination using the second lamp 151 is not carried out.

In a case in which the irradiation-part base part 14 is turned about the first turning shaft 13 or in a case in which the irradiation-part distal end part 15 is turned about the second turning shaft 16, it is preferred to act predetermined turning resistance. By virtue of this, only in the case in which the force having a predetermined magnitude or more works, the irradiation-part base part 14 or the irradiation-part distal end part 15 can be turned, and the irradiation-part base part 14 or the irradiation-part distal end part 15 can be fixed at a desired set angle. Alternatively, it is possible to fix the irradiation-part base part 14 or the irradiation-part distal end part 15 at a desired set angle by providing a fixing mechanism that fixes the irradiation-part base part 14 or the irradiation-part distal end part 15, and the irradiation-part base part 14 or the irradiation-part distal end part 15 may be turned with small force.

The right-side surface of the grip 11 in FIG. 1A, in other words, the surface of the grip 11 in the side that abuts the irradiation-part distal end part 15 is an approximately flat surface or a curved surface having a large curvature radius. The left-side surface of the irradiation-part distal end part 15 in FIG. 1A, in other words, the surface of the irradiation-part distal end part 15 in the side that abuts the grip 11 is an approximately flat surface or a curved surface having a large curvature radius. On the other hand, the left-side surface of the grip 11 in FIG. 1A, in other words, the surface of the grip 11 in the opposite side of the surface in the side that abuts the irradiation-part distal end part 15 has a curved-surface shape (a curved-surface shape having a smaller curvature radius than the above-described curved surface having the large curvature radius) close to a curved surface forming an elliptical shape. The left-side surface of the irradiation-part distal end part 15 in FIG. 1A, in other words, the surface of the irradiation-part distal end part 15 in the opposite side of the surface in the side that abuts the grip 11 has a curved-surface shape (curved-surface shape having a smaller curvature radius than the above-described curved surface having the large curvature radius) close to the curved surface forming an elliptical shape. Therefore, as shown in FIG. 1C, the overall cross section of the state in which the grip 11 and the irradiation-part distal end part 15 abut each other is formed so as to have an approximately elliptical shape. This cross-sectional shape and the size thereof are set so that the operator can hold the grip 11 and the irradiation-part distal end part 15 together. As shown in FIG. 1A, the shape of the grip 11 in the vertical direction in the right side, in other words, the shape of the grip 11 in the vertical direction in the side of the irradiation-part distal end part 15 is an approximately linear shape in the longitudinal direction so as to cause the grip 11 and the irradiation-part distal end part 15 to abut each other. As shown in FIG. 1A, in the left side of the grip 11, in other words, in the side of the grip 11 opposite to the side of the irradiation-part distal end part 15, an elastic material (elastomer) 111 is attached so that the operator can easily hold the grip 11 from the side of the irradiation-part distal end part 15. As shown in FIG. 1C, the irradiation-part distal end part 15 is formed to be thinner than the grip 11, and the operator can hold only the grip 11.

The form of FIG. 1 shows a state in which the turning angle of the irradiation-part base part 14 about the first turning shaft 13 and the turning angle of the irradiation-part distal end part 15 about the second turning shaft 16 are set so that the torch light 10 has the most compact form. Therefore, when the torch light 10 is carried in an unused state, the form of FIG. 1 is normally employed.

Figure 2:
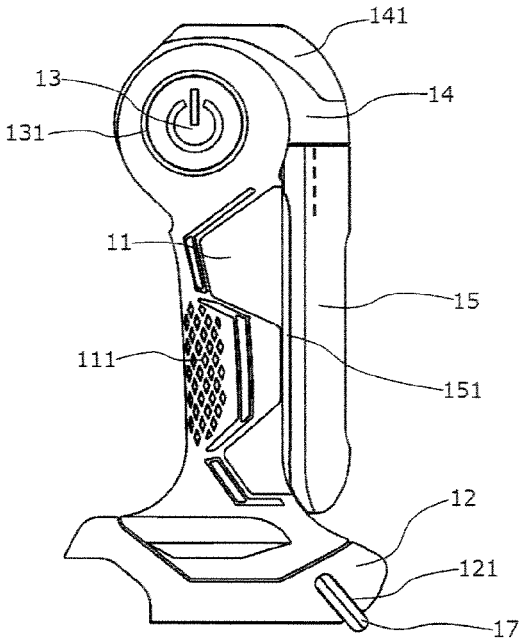
FIG. 2 is a side view showing a form of a case in which a battery is not attached in the torch light according to the embodiment of the present invention.

In the state of FIG. 1A, the battery 100 can be slid in the front-back direction (the direction shown by a white arrow). By virtue of this, the battery 100 is moved along a rail provided in the side of the battery retaining part 12 and is fixed to the battery retaining part 12 at an appropriate position by a latch mechanism. This latch mechanism is released when latch release buttons 101 provided on the battery 100 are pushed. The latch release buttons 101 are provided not only in the side of the battery 100 shown in FIG. 1A, but also on the surface of the battery 100 in the opposite side. The operator detaches/attaches the battery 100 from/to the battery retaining part 12 while pushing these two latch release buttons 101. FIG. 2 is a drawing showing a form of the torch light 10 in which the battery 100 is detached from the battery retaining part 12 and is a drawing corresponding to FIG. 1A. In FIG. 1A, the battery 100 is attached to the battery retaining part 12 from the left side of the drawing. In order to facilitate this operation, the latch release buttons 101 are provided in the left side of the battery 100 in the drawing.

A hook 17 is attached to the battery retaining part 12. The hook 17 is used for latching the torch light 10 to a projection provided on a wall or the like. The hook 17 is attached to the battery retaining part 12 via a wire (not shown). When the hook 17 is not used, the hook 17 is housed in a hook housing opening 121, which is provided on the battery retaining part 12. The hock 17 is used in a case in which the torch light 10 is stored by hanging when it is not used or in a case in which the torch light 10 is used as illumination by hanging the torch light on the wall or the like.

Regarding the above-described torch light 10, the operator can carry and use the torch light 10 and also can use the torch light 10 while the torch light is placed on a work table or the like. In either case, the direction illuminated by the torch light 10 can be adjusted to an optimum direction in an operation. Hereinafter, a mode of a case in which the operator carries and uses the torch light 10 will be explained. In this case, the second lamp 151 and the first lamp 141 can be simultaneously used for illumination.

Figure 3:
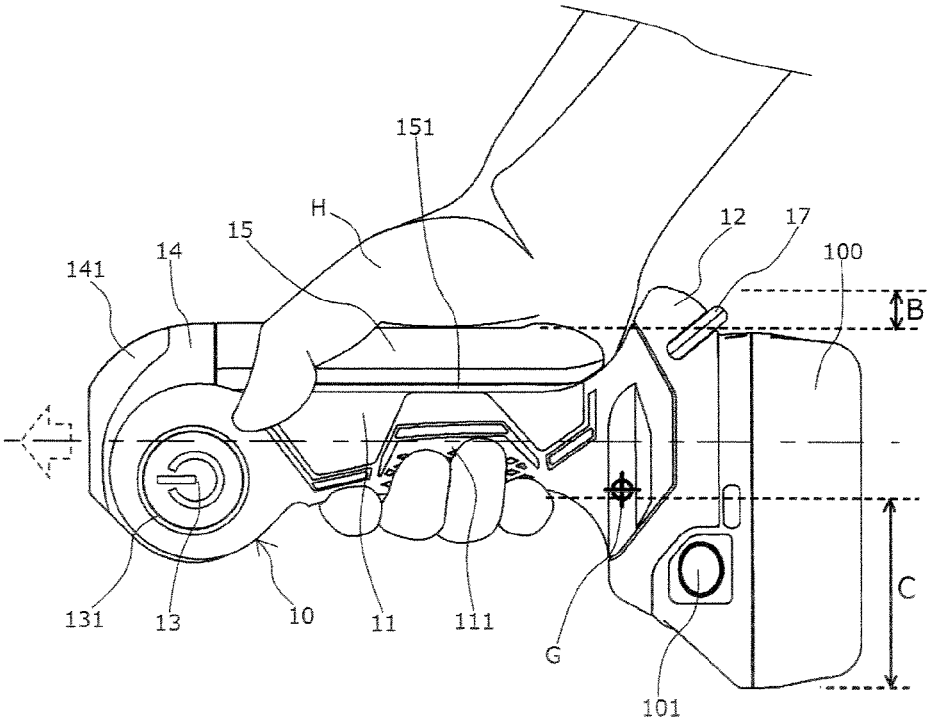
FIG. 3 is a side view showing a configuration of a case in which the torch light according to the embodiment of the present invention is carried.

FIG. 3 is a drawing showing a situation in which the operator holds the torch light 10, which is in the form shown in FIG. 1. As shown in FIG. 3, the operator positioned in the right side of the drawing holds, by the hand H, the part at which the irradiation-part distal end part 15 and the grip 11 are integrated while the side of the battery 100 is in the near side. As a result, light can be emitted approximately forward (in the direction of a broken-line white arrow in FIG. 3) from the first lamp 141 of the torch light 10. When the irradiation-part base part 14 is turned about the first turning shaft 13 in the state in which the grip 11 is held by the hand H, the direction of the light emitted by the first lamp 141 can be adjusted. FIG. 4A to FIG. 4D respectively show the forms of the cases in which the turning angle of the irradiation-part base part 14 are changed by 45°, 90°, 135°, and 180° counterclockwise from the state of FIG. 3. In this manner, the direction of the light emitted from the first lamp 141 can be adjusted by turning the irradiation-part base part 14 centering around the first turning shaft 13. Irradiation by the second lamp 151 cannot be practically carried out by the form shown in FIG. 3; on the other hand, in the forms shown in FIG. 4A to FIG. 4D, irradiation from the rear side to the upper side can be carried out.

Figure 4A:
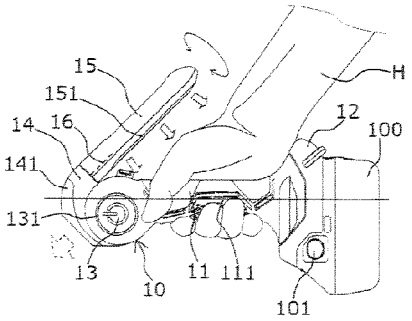
FIGS. 4A to 4D are drawings showing configurations of the cases in which the turning angle about a first turning shaft is adjusted when the torch light according to the embodiment of the present invention is carried and used.
Figure 4B:
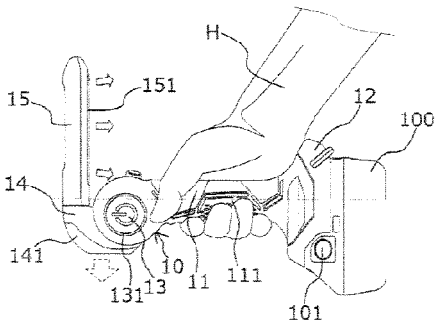
Figure 4C:
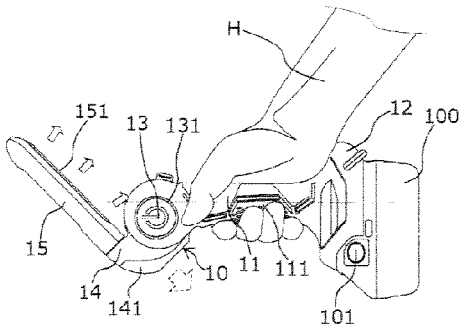
Figure 4D:
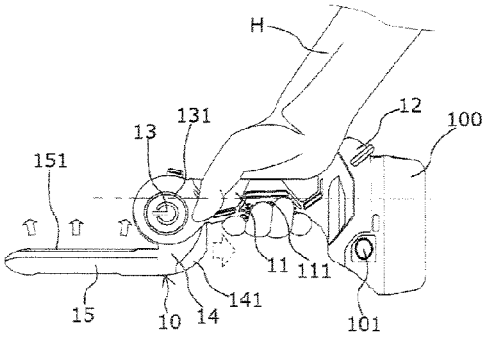
Figure 5A:
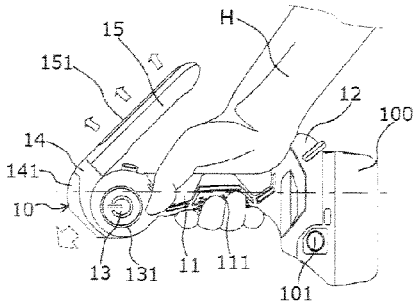
FIGS. 5A to 5D are drawings showing configurations of the cases in which the turning angle about the first turning shaft is adjusted when the torch light according to the embodiment of the present invention is carried and used.
Figure 5B:
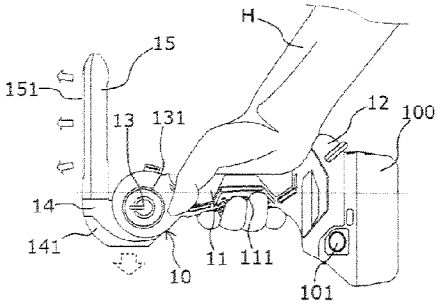
Figure 5C:
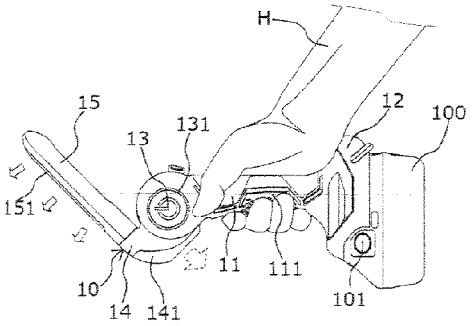
Figure 5D:
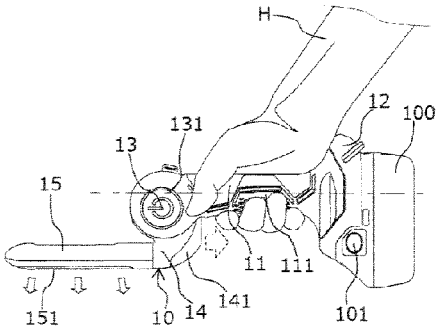

The movable range of the irradiation-part base part 14 turned about the first turning shaft 13 is limited in a clockwise direction when the irradiation-part distal end part 15 abuts the upper side of the grip 11 as shown in FIG. 1A. On the other hand, in the counterclockwise direction, the movable range is limited when the end part of the irradiation-part base part 14 in the counterclockwise-direction side abuts the grip 11. In the case shown in the figure, as shown in FIG. 4D, the case in which the turning angle of the irradiation-part base part 14 centering around the first turning shaft 13 is 180° is the turning limit of the irradiation-part base part 14 in the counterclockwise direction. The counterclockwise-direction movable range of the irradiation-part base part 14 can be set to be larger than 180° depending on the structure of the irradiation-part base part 14. However, it is difficult to set the counterclockwise-direction turning angle of the irradiation-part base part 14 to nearly 360°. Therefore, in the form shown in FIG. 4A to FIG. 40, it is difficult to irradiate the front side or the lower side by the second lamp 151.

On the other hand, the irradiation-part distal end part 15 can be turned centering around the second turning shaft 16 with respect to the irradiation-part base part 14. Each of FIG. 5A to FIG. 5D shows the states in which the irradiation-part distal end part 15 is turned by 180° about the second turning shaft 16 from the states shown in each of FIG. 4A to FIG. 4B. In this case, light can be irradiated from the upper side to the front side and from the front side to the lower side by using the second lamp 151 by adjusting the turning angle of the irradiation-part base part 14, which is turned centering around the first turning shaft 13. More specifically, in a state in which the operator is holding the grip 11, the turning angle of the irradiation-part base part 14 about the first turning shaft 13 is adjusted, and the turning angle of the irradiation-part distal end part 15 about the second turning shaft 16 is adjusted. In this manner, when the turning angles of the irradiation-part base part 14 and the irradiation-part distal end part 15 are adjusted, in the rear side, the upper side, the front side, and the lower side, the directions in the range not interrupted by the grip 11, etc. can be irradiated by the second lamp 151.

The states shown in FIG. 5A to FIG. 5D are the states after the irradiation-part distal end part 15 is turned by 180° about the second turning shaft 16 from the states shown in FIG. 4A to FIG. 4D. However, in practice, the turning angle of the irradiation-part distal end part 15 can be optionally set. Therefore, for example, the irradiation direction of the second lamp 151 can be changed to the near side with respect to the plane of the paper or the far side with respect to the plane of the paper in FIG. 4 and FIG. 5, in other words, to the direction (lateral side of the torch light 10) parallel to the axial direction of the first turning shaft 13.

Figure 6A:
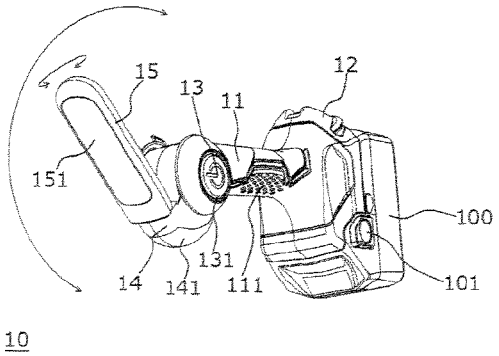
FIGS. 6A and 6B are drawings showing configurations of the cases in which the turning angles about the first turning shaft and a second turning shaft are adjusted in the torch light according to the embodiment of the present invention.
Figure 6B:
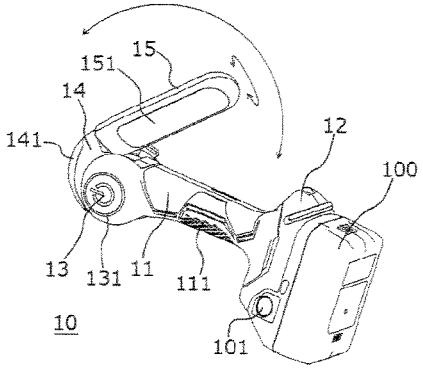
Figure 7A:
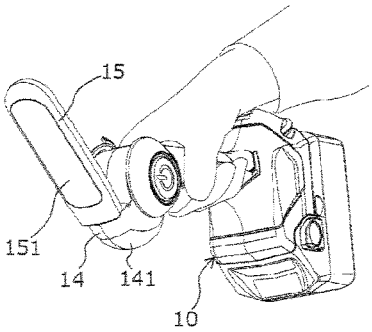
FIGS. 7A and 7B are drawings showing configurations of the cases in which the torch light according to the embodiment of the present invention is carried in the states in which the turning angles about the first turning shaft and the second turning shaft are adjusted.
Figure 7B:
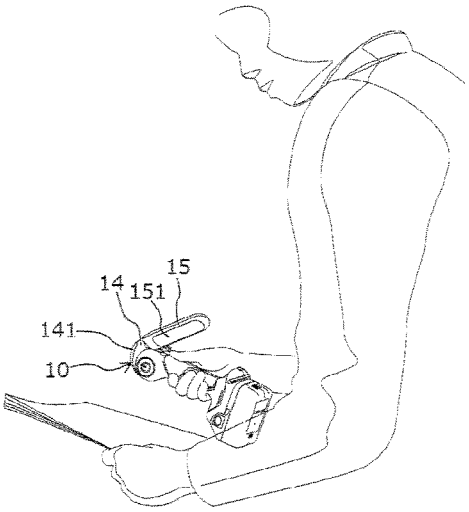

Therefore, the irradiation direction of the second lamp 151 can be changed to an oblique front side as shown in FIG. 6A and to an oblique rear side as shown in FIG. 6B when viewed from the operator. FIG. 7A and FIG. 73 show the positional relations between the torch light 10 and the operator in the cases in which the torch light 10 is in the forms of FIG. 6A and FIG. 6B. Particularly in the case in which the irradiation direction of the second lamp 151 is the oblique rear side as shown in FIG. 7B, for example, the operator holds the torch light 10 by the right hand, and an instruction manual held by the left hand can be irradiated by the second lamp 151 while operation equipment positioned in the front side of the operator is irradiated by the first lamp 141. Thus, an operation in a dark environment can be efficiently carried out by using the torch light 10.

As shown in FIG. 1A, the grip 11 is deviated to the right side with respect to the battery 100. Therefore, as shown in FIG. 3, the gravity center G of the torch light 10 is positioned below the central axis of the grip 11 in FIG. 3. More specifically, when the irradiation-part distal end part 151 is folded down, the gravity center G of the torch light 10 is positioned to be deviated to the side the other side of the grip) which is opposite to the side of the grip 11 abutting the irradiation-part distal end part 151. Therefore, in the forms of FIGS. 4A to 4D. FIGS. 5A to 5D, and FIGS. 7A and 7B, the gravity center of the torch light 10 is at a low position, and the operator can stably hold the torch light 10.

As shown in FIG. 3, the projecting length of the battery 100 or the battery retaining part 12 is different in the upper side and the lower side of the grip 11. More specifically, the projecting length B in the upper side of the grip 11 is shorter than the projecting length C in the lower side of the grip 11. More specifically, the projecting length which is the distance between the battery 100 or the battery retaining part 12 and the grip is B which is the side in which the irradiation-part distal end part 15 is present (upper side in FIG. 3: one side), and is C which is the opposite side thereof in which the irradiation-part distal end part 15 is not present (lower side in FIG. 3: the other side). Since the grip 11 is deviated to the right side with respect to the battery 100 as shown in FIG. 1A, the projecting length B is shorter than the projecting length C (C>B). In other words, the distance B between the grip 11 in the upper side (one side) of the grip 11 and the portion of the battery 100 or the battery retaining part 12 which is the farthest from the grip 11 is shorter than the distance C between the grip 11 in the lower side (the other side) of the grip 11 and the portion of the battery 100 or the battery retaining part 12 which is the farthest from the grip 11. The above-described projecting distance is the distance between the portion of the battery 100 or the battery retaining part 12 which is the farthest from the grip 11 and the surface of the grip 11 when viewed from the axis connecting one end side and the other end side of the grip 11.

In this manner, in one side and the other side of the grip 11, the projecting lengths of the battery 100, etc. are different. Therefore, as shown in FIGS. 4A to 4D, FIG. 5A to 5D, and FIGS. 7A and 7B, when the operator holds the grip 11 from the side in which the irradiation-part distal end part 15 is present, in other words, from the side in which the projecting length of the battery 100, etc. is short, the hand does not easily contact the battery 100 and the battery retaining part 12. In the state of FIG. 1A in which the irradiation-part distal end part 15 is along the grip 11, the operator holds the cross-sectional structure consisting of the irradiation-part distal end part 15 and the grip 11 (the structure shown in FIG. 1C); therefore, the hand that holds this structure further does not easily abut the battery 100 and the battery retaining part 12. Therefore, regardless of the set angle of the irradiation-part distal end part 15, the operator can easily carry the torch light 10. In this case, since the elastic material 111 is provided at the part to which load is applied the most by the hand holding the grip 11, carrying of the torch light 10 is further facilitated by the elastic material 111.

As shown in FIG. 1A, the battery 100 is provided with the latch release buttons 101. When the battery 100 is to be detached/attached, the operator slides the battery 100 while pushing the latch release buttons 101. As described above, the latch release buttons 101 are provided in the left side of the battery 100 in FIG. 1A. In other words, the latch release buttons 101 are provided in the side which is held when the battery 100 is attached. In order to maintain the total height of the torch light 10 in FIG. 1A to be low and facilitate the operation of the latch release buttons 101 by the operator, the latch release buttons 101 provided on the battery 100 are preferred to be positioned in the left side or the right side of the grip 11 in FIG. 1A. In this case, in order to set the projecting length of the battery 100 or the battery retaining part 12 to be C>B as described above, it is obvious that the latch release buttons 101 are preferred to be disposed in the left side in FIG. 1A. Therefore, it is particularly preferred that the battery 100 be attached to the battery retaining part 12 from the side to which the grip 11 deviates and is fixed (the right side in FIG. 1A) or from the opposite side (the left side in FIG. 1A) so as to facilitate carrying of the torch light 10 and facilitate detaching/attaching operations of the battery 100.

Next, a mode of a case in which the above-described torch light 10 is placed on a work table or the like to be used will be explained. In this case, when the torch light 10 is placed so that the battery 100 contacts the ground or the like as shown in FIG. 1A and FIG. 1B, the battery 100 can be particularly stably placed.

Figure 8A:
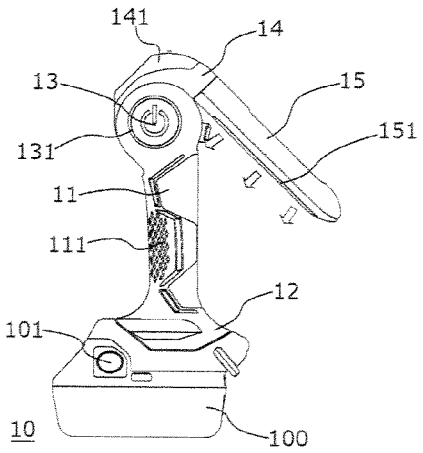
FIGS. 8A to 8D are drawings showing configurations of the cases in which the turning angle about the first turning shaft is adjusted when the torch light according to the embodiment of the present invention is placed and used.

In this case, the second lamp 151, which has a large light-projection area since it has a large area, can be mainly used. Each of FIG. 8A to FIG. 8D shows the state that the above-described torch light 10 is placed and that the irradiation-part distal end part 15 and the irradiation-part base part 14 are turned about the first turning shaft 13 from the state of FIG. 1A. More specifically, FIG. 8A to FIG. 8D respectively show the forms of the cases in which the irradiation-part distal end part 15 and the irradiation-part base part 14 are turned by 45°, 90°, 135°, and 180° counterclockwise from the state of FIG. 1A. FIG. 8D shows the state in which the irradiation parts 13 and 15 are turned to a first position at which they are extending from the upper end of the grip 11 to the upper side. Furthermore, FIG. 8B shows the state in which the irradiation parts 13 and 15 are turned to a third position at which they are extending from the upper end of the grip 11 to the rear side.

In the cases shown in FIG. 8A to FIG. 8D, the lower side to the right side in FIGS. 8A to 8D can be irradiated by the second lamp 151. As well as FIGS. 5A to 5D, it is obvious that the upper side to the front side in FIGS. 8A to 8D can be also irradiated by the second lamp 151 by turning the irradiation-part distal end part 15 about the second turning shaft 16. Therefore, as well as the cases shown in FIGS. 4A to 4D and FIGS. 5A to 5D, in other words, the cases in which the torch light 10 is carried and used, most directions can be irradiated by the second lamp 151 even when the torch light 10 is placed and used.

Figure 8B:
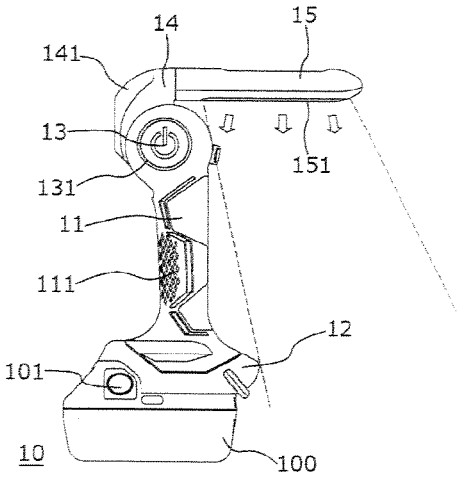
Figure 8C:
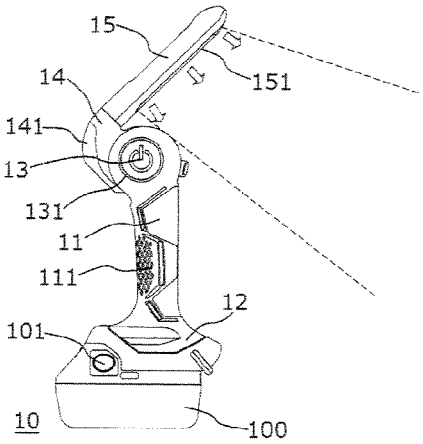
Figure 8D:
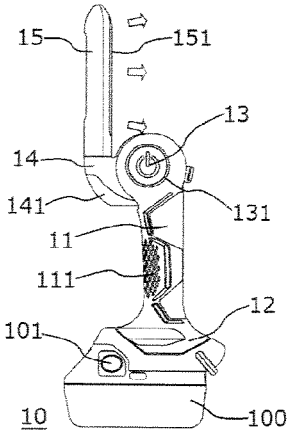

However, in the cases in which the lower side is irradiated by the second lamp 151 as shown in FIGS. 8B and 8C, as shown by broken lines, the irradiation ranges in the side close to the grip 11 is limited by the grip 11, the battery retaining part 12, or the battery 100. Particularly in the case in which the second lamp 151 irradiates immediately therebelow as shown in FIG. 83, light is interrupted by the battery retaining part 12 or the battery 100. Regarding this point, the range in which the light is interrupted by the battery retaining part 12 or the battery 100 can be narrowed since the projecting length B is shorter than the projecting length C (C>B) in the torch light 10 as shown in FIG. 3. Thus, when the torch light 10 is placed and used, the projection-light range toward the lower side can be expanded. Such a characteristic is particularly effective, for example, when the torch light 10 is placed on a work table to be used.

In this manner, the characteristic that various directions can be irradiated is realized by changing the form of the torch light 10 to the forms shown in FIGS. 1A and 1B and the forms shown in FIGS. 8A to 83. More specifically, the characteristic of irradiating wide directions is realized, since the form in which the irradiation-part distal end part 15 is disposed along the grip 11 (the form shown in FIGS. 1A and 1B) can be changed to the form in which the irradiation-part distal end part 15 is turned about the first turning shaft 13 so as to be distant from the grip 11 (the forms shown in FIG. 8A to 8D). In the forms shown in FIGS. 1A and 1B, the irradiation-part distal end part 15 is provided along the side in which, when viewed from the axis of the grip 11, projections of the battery retaining part 12 and the battery 100 from the grip 11 are small. In the forms shown in FIGS. 8A to 8D, the first turning shaft 13 serving as a turning center is provided in the side opposite to the battery retaining part 12.

Thus, regarding the above-described torch light 10, both in the state in which the torch light 10 is carried by the operator and in the case in which the torch light 10 is placed, a wide range can be set as the directions irradiated by the second lamp 151. FIGS. 8A to 8D describe only the irradiation by the second lamp 151; however, it is obvious that the irradiation directions of the first lamp 141 are similarly set. More specifically, it is obvious that the first lamp 141 can be used not only in the case in which the torch light 10 is held by the operator, but also in the state in which the torch light 10 is placed.

As described above, the torch light 10 is hung by using the hook 17. Therefore, when the turning angles of the irradiation-part base part 14 and the irradiation-part distal end part 15 are set as shown in FIGS. 4A to 4D and FIGS. 5A to 5D in the state in which the torch light 10 is hung, a wide range can be similarly irradiated by the torch light 10.

Figure 9A:
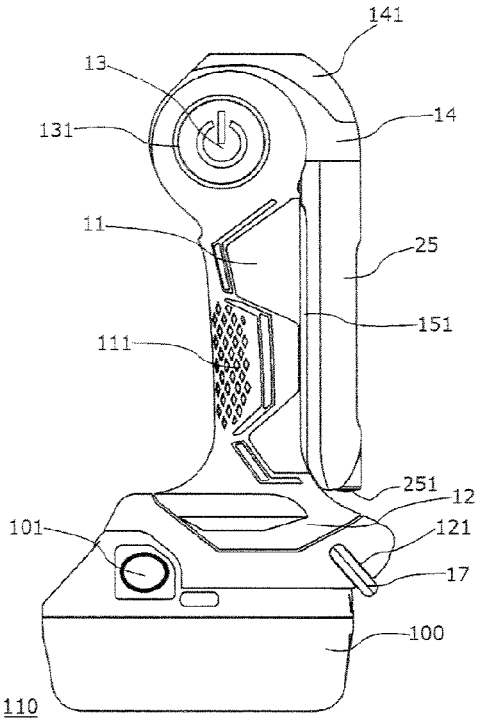
FIG. 9A is a side view of a modification example of the torch light according to the embodiment of the present invention.
Figure 9B:
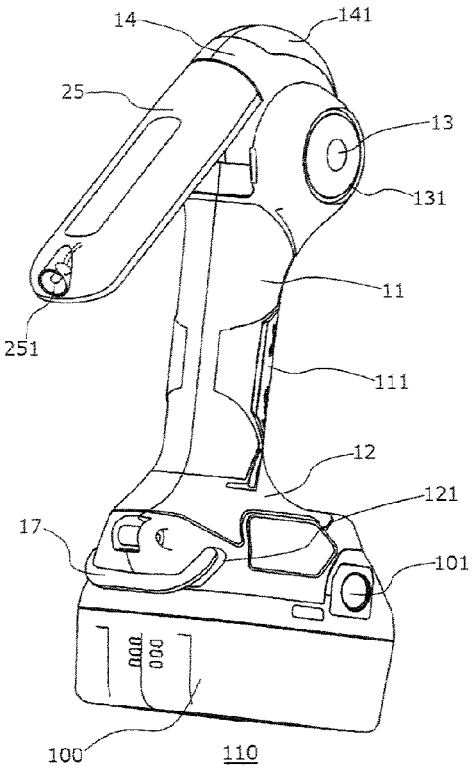
FIG. 9B is a perspective view thereof.

Next, modification examples of the above-described torch light 10 will be explained. In the above-described torch light 10, the first lamp 141 and the second lamp 151 are used. However, in order to improve convenience, a third lamp can be further provided. FIG. 9A is a side view showing the structure of a torch light 110, which is a modification example, and FIG. 9B is a perspective view showing the structure of the torch light 110. FIG. 9A shows the same form as that of FIG. 1A.

In the torch light 110, the structures such as the grip 11, the battery retaining part 12, the battery 100, the first turning shaft 13, the irradiation-part base part 14, and the hook 17 are similar to those of the above-described torch light 10. Moreover, although not shown in the figure, the torch light 110 is also provided with a second turning shaft, as in the torch light 10. However, although the irradiation-part distal end part 25 provided in the torch light 110 is provided with the above-described second lamp 151, a third lamp 251 is further provided at a tip of the irradiation-part distal end part 25. Although the third lamp 251 is further smaller than the first lamp 141, the operator can bring the third lamp 251 close to an irradiation target (for example, a small sample, etc.) since the third lamp is provided at the tip of the irradiation-part distal end part 25. In this case, it is obvious that the first lamp 141 or the second lamp 151 may be simultaneously used other than the third lamp 251. Therefore, the third lamp 251 can be subsidiarily used when the first lamp 141 or the second lamp 151 is used.

Figure 10:
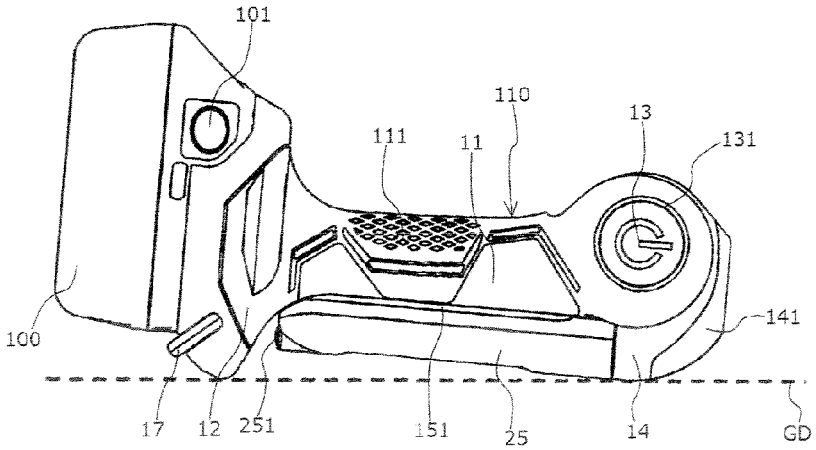
FIG. 10 is a drawing showing a form of a case in which the modification example of the torchlight according to the embodiment of the present invention is placed on a flat surface.

As the third lamp 251, for example, a single-element LED not provided with a large lens or the like can be used since it is provided at the tip of the irradiation-part distal end part 25. On the other hand, if the third lamp 251 is not provided with a lens or the like, the third lamp 251 is particularly easily broken. FIG. 10 is a drawing showing a state in which the torch light 110 in the form shown in FIG. 9A is placed on a flat ground (flat surface) GD. As shown in FIG. 10, in the state in which the irradiation-part distal end part 25 is folded down along the grip 11, the third lamp 251 is prevented from abutting the ground GD, and the third lamp 251, which is easily broken, is protected. More specifically, even in a case that the projecting length B is formed to be shorter than the projecting length C (C>B) as shown in FIG. 3 and that the torch light 110 is placed on the ground GD from the side of the projecting length B as shown in FIG. 10, the upper end of the grip 11 or the irradiation-part base part 14 is brought into contact with the ground GD, and the battery retaining part 12 or the battery 100 is brought into contact with the ground GD, and as a result, contact of the third lamp 251 with the ground GD is avoided. Such a protecting function of the third lamp 251 is exerted not only in the case in which the torch light 110 is placed, but is similarly exerted also, for example, in a case in which the torchlight 110 is dropped while being carried. Thus, the third lamp 251 can be protected since the third lamp 251 is provided at the distal end part of the irradiation-part distal end part 25.

In the above-described explanation, the torch lights 10 and 110 are shown as examples of illuminating devices. However, the present invention is not limited to torch lights, but may be applied to other illuminating devices. In the above-described examples, the first and second lamps in the torch lights 10 and 110, or the third lamp is further used therein in addition to those lamps, but another lamp can be further added to the torch lights. In such a case, the irradiation ranges of the lamps and the lighting methods of the lamps (continuous lighting, flashing, etc.) can be optionally set. The switching thereof can be carried out by a switch similar to the above-described switch 131.

The above-described examples employ the structure in which the first turning shaft 13 and the second turning shaft 16 are orthogonal to each other like a multilevel crossing. However, as long as the irradiation-part base part and the irradiation-part distal end part can be moved in the above-described manner, the first turning shaft 13 and the second turning shaft 16 are not required to be orthogonal to each other. Wide ranges can be irradiated in various modes by using the first lamp and the second lamp in the same manner as above, as long as the second turning shaft is set so as to intersect with the flat surface along which the irradiation-part base part is moved when the irradiation-part base part is turned about the first turning shaft, and as long as the second turning shaft is fixed to the irradiation-part base part.

Alternatively, in a structure in which the irradiation part which is turned about the first turning shaft is attached to the grip, even if the lamp provided in the irradiation part is single, it is obvious that carrying of the torch light is particularly facilitated if the projecting distances of the battery retaining part and the battery in the side (one side) in which the irradiation part is folded down are shorter than those in the other side like the above-described manner. Thus, such positional relations among the grip, the irradiation part, the battery retaining part, and the battery are effective regardless of the configuration of the lamp(s).

Examples of the embodiments of the illuminating device will be described, and examples of the effects obtained in the respective embodiments will also be described.

In an illuminating device according to an embodiment of the present invention, the illuminating device includes: a grip held by an operator and extending in a vertical direction; a battery connected to a lower end of the grip; and an irradiation part connected to an upper end of the grip, and the irradiation part is connected to the grip so that the irradiation part can be turned between a first position extending from the upper end of the grip to an upper side and a second position extending from the upper end of the grip to a lower side, a first lamp is provided on a grip-side end part of the irradiation part, and a second lamp is provided on a side surface of the irradiation part. By virtue of this, as shown in FIG. 3, it can be used as a flashlight in a state in which it is folded compactly, and, as shown in FIGS. 8A to 8D, it can be used as a working electric lamp by expanding the irradiation part.

In the illuminating device according to another embodiment of the present invention, the irradiation part is connected to the grip so that the irradiation part can be turned between the first position, the second position, and a third position extending from the upper end of the grip to a rear side, and the battery is disposed to be shifted to a front side with respect to the grip. By virtue of this, when the illuminating device is used in the forms shown in FIGS. 4A to 4D and FIGS. 5A to 5D, the weight balance of the illuminating device is good, and the operator can easily hold the illuminating device.

In the illuminating device according to another embodiment of the present invention, the second lamp irradiates a rear side of the grip, and the battery is disposed to be shifted to a front side with respect to the grip. By virtue of this, when the illuminating device is used in the form shown in FIG. 8B, a large irradiation range can be irradiated by the illuminating device.

In the illuminating device according to another embodiment of the present invention, a direction irradiated by the first lamp and a direction irradiated by the second lamp intersect with each other, and a switch capable of switching whether the first lamp is to carry out irradiation or the second lamp is to carry out irradiation is provided at a position at which the switch can be operated from outside even in a state that the irradiation part is at the second position. By virtue of this, in the state in which it is compactly folded down as shown in FIG. 3, it can be used while the first lamp and the second lamp are switched.

What is claimed is:

1. A portable illuminating device comprising:

a battery as a power source;

a handle adapted to be held by a hand of an operator;

a base attached to one end of the handle and movable as a whole with respect to the handle;

a first lamp integrally formed in the base; and a second lamp movably attached to the base, wherein the base, the first lamp, and the second lamp are movable as a whole with respect to the handle, the second lamp is movable with respect to the base, the first lamp, and the handle, the first lamp has a first position to emit light along a longitudinal direction of the handle and a second position to emit light along a direction perpendicular to the longitudinal direction, the second lamp has a third position to emit light along the longitudinal direction and a fourth position to emit light along the direction perpendicular to the longitudinal direction, the device is placeable on a surface while the longitudinal direction of the handle is maintained perpendicular to the surface, and the first lamp is different from the second lamp.

2. The portable illuminating device according to claim 1, further comprising a switch that selectively turns on the first lamp and the second lamp.

3. The portable illuminating device according to claim 1, wherein the second lamp comprises a plurality of LEDs.

4. The portable illuminating device according to claim 3, wherein the second lamp has a rectangle-like shape.

5. The portable illuminating device according to claim 3, further comprising a switch that controls luminance of the second lamp.

6. The portable illuminating device according to claim 1, wherein the base has a movable range relative to the handle, and a relative position of the base to the handle is held within the movable range of the base.

7. The portable illuminating device according to claim 1, wherein the base has a first movable range relative to the handle, the second lamp has a second movable range relative the base, and a relative position of the second lamp to the base is held within the second movable range.

* * * * *